US005702354A

United States Patent [19]

DeSpain et al.

[11] Patent Number: 5,702,354

[45] Date of Patent: Dec. 30, 1997

[54] TOE JOINT MOBILIZATION APPARATUS

[75] Inventors: Julianne M. DeSpain, Westminster, Colo.; Lawrence D. Oloff, Los Altos; Theodore W. Rogers, Palo Alto, both of Calif.

[73] Assignee: Active Motion Systems, LLC, Palo Alto, Calif.

[21] Appl. No.: 529,630

[22] Filed: Sep. 18, 1995

Related U.S. Application Data

[63] Continuation-in-part of Ser. No. 161,118, Dec. 2, 1993, abandoned.

[51] Int. Cl.[6] ..... A61H 1/00

[52] U.S. Cl. ..... 601/27; 601/29; 601/31; 482/79; 482/132

[58] Field of Search ..... 482/79, 80, 131, 482/132, 146, 147, 907, 148, 139; 601/27, 29, 31, 32, 33; 602/30; 273/85 B, 85 D, 54 B, 441, 449; 446/26

[56] References Cited

U.S. PATENT DOCUMENTS

| | | | |
|---|---|---|---|
| 1,497,243 | 6/1924 | Martin . | |
| 1,516,464 | 11/1924 | Taplin | 601/27 |
| 1,664,664 | 4/1928 | Crum . | |
| 1,801,769 | 4/1931 | Gartner . | |
| 1,978,244 | 10/1934 | Bach . | |
| 1,997,139 | 4/1935 | Gardener et al. . | |
| 1,998,197 | 4/1935 | Lang | 601/27 |
| 2,016,930 | 10/1935 | McCahan et al. . | |
| 2,104,927 | 1/1938 | Hussmann . | |
| 2,187,920 | 1/1940 | Triplett . | |
| 2,230,890 | 2/1941 | McClenathen . | |
| 2,250,493 | 7/1941 | Milne . | |
| 2,282,307 | 5/1942 | Davis . | |
| 2,513,408 | 7/1950 | Fayne . | |
| 2,553,873 | 5/1951 | Schwebel, Sr. . | |
| 3,088,458 | 5/1963 | Stewart . | |
| 3,472,508 | 10/1969 | Baker et al. . | |
| 3,606,316 | 9/1971 | Krewer . | |
| 3,622,152 | 11/1971 | Place . | |
| 3,984,100 | 10/1976 | Firster . | |
| 4,105,200 | 8/1978 | Unger . | |
| 4,218,093 | 8/1980 | Gertz | 482/148 |

(List continued on next page.)

FOREIGN PATENT DOCUMENTS

| | | | |
|---|---|---|---|
| 2388-549 | 11/1978 | France . | |
| 1986-06 | 12/1984 | France . | |
| 212524 | 2/1941 | Switzerland . | |
| 1724282 | 4/1992 | U.S.S.R. | 482/121 |
| 1745244-A1 | 7/1992 | U.S.S.R. . | |

*Primary Examiner*—Jeanne M. Clark
*Attorney, Agent, or Firm*—Donald W. Margolis

[57] ABSTRACT

The present invention relates to an apparatus for mobilizing the metatarsophalangeal (MTP) joint in a toe, especially after prolonged immobilization. It includes a member having a first curved surface for facilitating the rolling of the member and a second surface for receiving the plantar portion of a human foot, including a portion of the ball of the foot and at least one toe. The apparatus further includes a retainer for securing a single toe to the member. In use, a patient places a foot on the second surface of the member with the ball of the foot and at least a to-be-treated toe contacting the second curved surface. Then, using the retainer, the single to-be-treated and mobilized toe is secured to the member. Thereafter, the patient may impose either plantarflexion or dorsiflexion motion to the single to-be-treated toe by rolling the member either forward or backward. If the member is rolled forward, the single to-be-treated toe is pulled downward, thereby imparting a plantarflexion motion to the MTP joint of that toe. If the member is rolled backward, the single to-be-treated toe is pushed upward, thereby imparting a dorsiflexion to the MTP joint of that toe. Thus, by simply rolling the member, the patient mobilizes the MTP joint of a single to-be-treated toe, which aids in the healing of the MTP joint after prolonged immobilization.

24 Claims, 4 Drawing Sheets

U.S. PATENT DOCUMENTS

| | | | |
|---|---|---|---|
| 4,644,940 | 2/1987 | Nakamura . | |
| 4,726,357 | 2/1988 | Destefano . | |
| 4,790,529 | 12/1988 | Pelle | 482/148 |
| 4,862,875 | 9/1989 | Heaton . | |
| 4,869,499 | 9/1989 | Schiraldo . | |
| 4,984,784 | 1/1991 | Bailey . | |
| 5,010,878 | 4/1991 | Kline et al. . | |
| 5,094,226 | 3/1992 | Medcalf et al. . | |
| 5,135,450 | 8/1992 | Smith, IV . | |
| 5,178,137 | 1/1993 | Goor et al. . | |
| 5,222,925 | 6/1993 | Maycock et al. . | |
| 5,236,411 | 8/1993 | Backman . | |
| 5,411,456 | 5/1995 | Lay | 482/79 |

TOE JOINT MOBILIZATION APPARATUS

RELATED PATENT APPLICATIONS

This invention is a continuation in part of U.S. Patent application 08/161,118, filed Dec. 2, 1993, and now abandoned.

FIELD OF THE INVENTION

This invention relates generally to therapeutic medical devices and more particularly to a cost effective and simple apparatus for mobilizing and exercising toe joints.

DESCRIPTION OF THE BACKGROUND ART

In order to function well, joints need to be moved on a regular basis. If a joint is immobilized for a long period of time, the soft tissue structures around the joint begin to go through certain physiological changes. Immobilization reduces the amount of circulation to the joint area and also decreases the extensibility of the joint capsule, ligaments, and muscles around the joint. The result is that the joint stiffens, causing normal movements to be painful and causing the range of motion attainable with the joint to be reduced. It is generally known that prolonged immobilization of a joint is harmful. However, there are many instances in which it is necessary to temporarily immobilize a joint despite the possibly harmful effects. For example, after bunion surgery, the great toe needs to be immobilized for a certain period of time to allow for bone union and healing. Joints may also need to be immobilized after muscle tendon injuries, joint sprains, soft tissue injury, or just overuse.

In those instances where prolonged immobilization of a joint is unavoidable, the joint should be exercised at the earliest possible opportunity to minimize the harmful effects of the immobilization. Early mobilization of the metatarsophalangeal joint (MTP) enhances the ability of the patient to walk without limping since the flexibility of the MTP is crucial to a normal walking gait. There are basically two types of exercise in which the muscles around a joint may be engaged. The first type is active motion exercise in which the muscles actively initiate the motion. While this type of exercise is ideal for strengthening the muscles, it is initially very painful. Hence, patients are often hesitant to perform it. Also, because this type of exercise requires active muscle motion, it typically should not be performed until the patient is fairly far along in the recovery process. Consequently, active motion exercise alone is not enough for an optimal recovery. The second type of exercise requires passive motion. In passive exercise an external source is used to initiate a particular motion, and this motion is thereafter applied to the joint to induce motion in the joint. By moving the joint, circulation is improved and stiffness is reduced. Because no active muscle exertion is required, passive motion exercise is significantly less painful and more controlled, in both arc and intensity, than active motion exercise. Also, it may be performed much earlier in the recovery process. Hence, passive motion exercise contributes to an optimal recovery.

Due to the positive effects of passive motion exercise, there are currently available a variety of continuous passive motion (CPM) machines which passively exercise various joints in the body. While these CPM machines are useful, they have a number of practical drawbacks. First, most CPM machines are quite expensive, and, for patients having little or no medical insurance, CPM machines are prohibitively expensive. Also, most CPM machines are complicated to use, requiring instruction from a representative of the medical supplier or a health care professional. This adds further cost to an already expensive machine. In addition, most CPM machines are incapable of reproducing the "glide" motion which is a component of normal joint motion. Furthermore, no prior an CPM machine which is known to be available is capable of producing a traction force on the joint. This traction force is important for early stretching of the joint. Because of the above drawbacks, the currently available CPM machines leave much to be desired. A need exists for an improved apparatus for exercising a joint after prolonged immobilization.

Place U.S. Pat. No. 3,622,152 teaches a device comprised of a sphere which rotates within a concave retaining member. In one embodiment the entire foot of a user is encircled with a strap or clamp which is connected to the retaining member so that the entire foot of the user rolls with the retaining member when the sphere is rolled. It does not teach or suggest that a single toe be strapped or clamped to either the retaining member or to the sphere in order to impart plantarflexion or dorsiflexion to the MTP joint of a single to-be-treated toe. In fact, the sphere is not in direct contact with either the foot or with any toe. Due to the fact that no single toe is secured to the sphere, no single toe is subject to plantarflexion or dorsiflexion of the MTP joint when the sphere of Place is rolled. Furthermore, Place neither teaches nor suggests an apparatus for imparting plantarflexion or dorsiflexion to the MTP joint of a single to-be-treated toe.

Backman U.S. Pat. No. 5,236,411 teaches an inflatable sphere which includes a strap, for elevating a limb of a patient to a given position without any form of exercise to any joint. It is a non-analogous art with respect to treatment of the foot and plantarflexion or dorsiflexion of the MTP joint of a toe, and neither teaches nor suggests a device for treating the feet or toes. Stewart U.S. Pat. No. 3,088,458 teaches a foot exercising appliance for exercising all of the toes, and the ligaments connecting the metatarsal and longitudinal arches, and the calcaneum of the user's foot. It consists of a portable base which supports two spaced apart rollers, one large primary roller and one smaller toe controlled roller. Both rollers are mounted on the base to slide both forward and backward, and to roll. In use, a user places there foot on the primary roller and pushed forward until the roller and foot assume a position which allows the foot to tilt and all of the toes to be moved downwardly in a manner in a manner which allows all of the toes to be moved downwardly in a manner to catch hold of and pick up the small roller. Then when the foot is moved back again and toward the body all of the toes are manipulated to release the small roller. This results in a massaging and invigorating exercise to the foot. All of the toes are exercised by clutching and maneuvering the small roller toward the larger roller. The ligaments are rejuvenated and circulation is activated by the rollers and rolling action along the plantar surface. However, it does not disclose a retainer for all or any of the toes. Due to the fact that no single toe is secured to the base, no single toe is subject to plantarflexion or dorsiflexion of the MTP joint during the use of Stewart. Furthermore, Stewart neither teaches nor suggests an apparatus for imparting plantarflexion or dorsiflexion to the MTP joint of a single to-be-treated toe.

Gardner et al. U.S. Pat. No. 1,997,139 teaches a foot exercising appliance for use in correcting fallen or weakened arches and strengthening the feet and legs, using the leg muscles. It does not provide passive exercise of all or any of the toes. The retainer strap of Gardner et al. secures the entire foot of a user to a plate mounted on revolving wheels.

However, it does not disclose a retainer for all or any of the toes. Due to the fact that no single toe is secured to the plate, no single toe is subject to plantarflexion or dorsiflexion of the MTP joint during the use of Gardner et al. Furthermore, Gardner et al. neither teaches nor suggests an apparatus for imparting plantarflexion or dorsiflexion to the MTP joint of a single to-be-treated toe.

Lang, Swiss Patent 212,524, noting that it teaches a substantially spherical member on which the foot of the user is placed for massage. Schwebel, Sr. U.S. Pat. No. 2,553,873 has a heated, vibrating drum member protruding from a ramp for treating the plantar portion of a foot. It requires no motion, and only provides pain relief and the improvement of circulation. Peru French Patent 2575-074-A includes spherical members which appear to be for use in exercising the entire leg, and which appears to provide no exercise for the toes. However, none of them teach or suggest a retainer for all or any of the toes. Due to the fact that no single toe is secured to their curved or spherical surfaces, no single toe is subject to plantarflexion or dorsiflexion of the MTP joint during the use of Lang; Schwebel, Sr.; or Peru, as well as many other foot exercise devices. Furthermore, Lang; Schwebel, Sr.; and Peru, and many other foot exercise devices neither teach nor suggest an apparatus for imparting plantarflexion or dorsiflexion to the MTP joint of a single to-be-treated toe.

More specifically, the known prior art fails to teach a device having a substantially curved lower surface member, such as a spherical ball or a cylinder, with an opposed surface for receiving the plantar portion of the foot of a user and including a retainer attachable to a single toe member while performing gliding plantarflexion and dorsiflexion on the MTP joint of that single toe. Furthermore, none of the known prior art devices would be useful for treatment of a single toe after surgery or trauma.

SUMMARY OF THE INVENTION

The present invention provides a simple, economical, and effective apparatus for use in passively exercising a single toe joint. The apparatus of the present invention comprises a member having a curved surface, and a retainer for securing a single toe to the member. The member preferably has a first curved surface for facilitating the rolling of the member, and a second surface for receiving at least a portion of the plantar portion of a human foot including the ball of the foot and the toes. The second surface preferably also has a single toe securing member. In one preferred embodiment the member takes the form of a substantially spherical ball. As detailed below, the sphere may be used with an optional track system. In a second preferred embodiment the member takes the form of a cylinder. Several forms of toe retainer are described below.

The optional tracking system for use with a spherical base member may comprise a track and an elongated heel guide. The track preferably takes the form of an elongated piece of material having a longitudinal cavity formed therein for receiving the curved surface of the member. The track guides the member to ensure that the member rolls along a selected axis. Similarly, the heel guide preferably takes the form of an elongated piece of material having a V-shaped or U-shaped groove formed therein for receiving the heel of a patient's foot. In the preferred embodiment, one end of the heel guide is pivotably attached to an end of the track by means of a hinge, while the other end of the heel guide is left free. This configuration allows a user to freely pivot the heel guide to form any desired angle with the track. In the alternative, the heel guide may have one end fixedly attached to an end of the track such that the heel guide forms a fixed, predetermined angle with the track.

To use the apparatus of the present invention with the optional tracking system, a patient first secures a single to be exercised toe to the curved member, as described in detail below. After a single toe is secured to the member, the patient may begin exercising the toe. It should be noted that the toe may be exercised using only the member. Use of a track is not essential. However, because the track guides the member and, thus, better directs the motion of the member, the member is preferably used in conjunction with the track. To do so, the user places the member in the cavity of the track to allow the track to guide the member as it rolls.

To impart plantarflexion motion to the single secured toe, the patient rolls the member forward. This forward rolling causes the member to pull the single secured toe downward, thereby imposing plantarflexion motion on the toe. To impart dorsiflexion to the single secured toe, the patient rolls the member backward. As the member is rolled backward, the heel of the foot slides up the groove in the heel guide, and as the heel slides up the guide, the single secured toe is bent upward, thereby imparting dorsiflexion motion to the single secured toe. Thus, using the apparatus of the present invention, a patient may passively exercise a joint of a single toe by simply rolling the member along the track.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawing which is incorporated in and forms a part of the specification illustrates complete preferred embodiments of the present invention according to the best modes presently devised for the practical application of the principles thereof, and in which.

DETAILED DESCRIPTION OF THE PREFERRED EMBODIMENTS

The apparatus of the present invention preferably comprises two major components: (1) a curved base member having a curved surface for facilitating the rolling of the base member, including, but not limited to a sphere or a cylinder; and (2) a retainer fixture for securing a single toe of a human foot to the base member. In some embodiments, as detailed below, an optional track system may be used to guide the curved base member as it rolls.

Figure 1A:
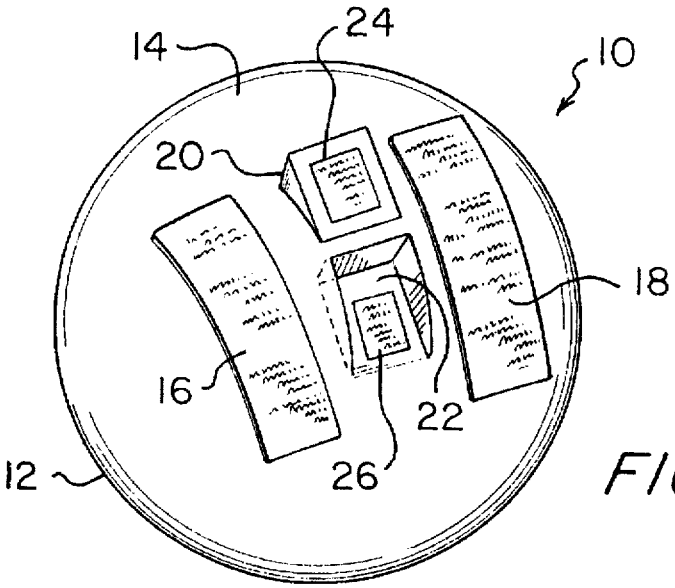
FIG. 1A is a top perspective view of one embodiment of the of the present invention in which the base member is in the form of a sphere.
Figure 1B:
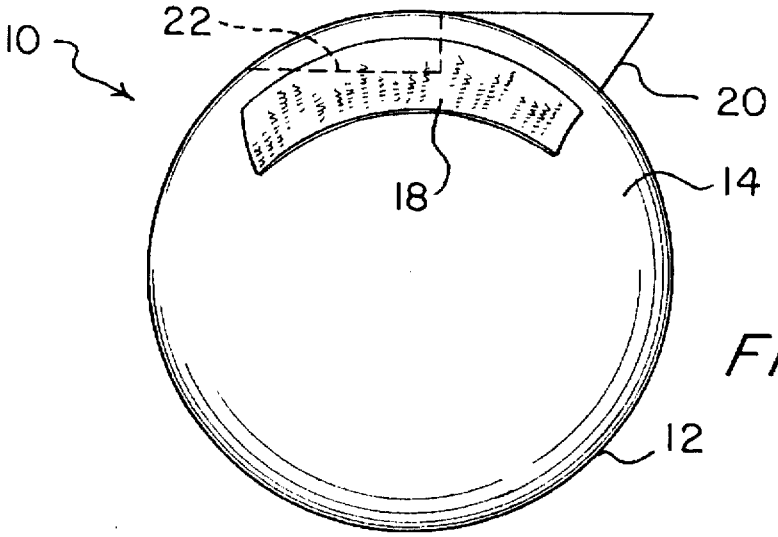
FIG. 1B is a perspective side view of the curved base member of FIG. 1A.

One preferred embodiment of the curved base member will now be described. With reference to FIGS. 1A and 1B, which show a perspective view and a side view, respectively, of one embodiment of the curved base member 10 of the present invention. This embodiment of the curved base member 10 is in the form of a substantially spherical ball constructed of a light weight, inexpensive, substantially non-crushable, substantially non-deformable material such as plastic, wood, or rigid foam, or the like. It includes a first curved surface 12 for facilitating the rolling of the curved base member on the floor, or on a track, or on any other appropriate firm surface, as described below. Curved base member 10 also includes a second surface 14 for receiving and accommodating the plantar portion of a human foot (see FIG. 5) including the ball of the foot and the toes. The diameter of spherical curved base member 10 may range from about twelve to about eighteen centimeters (about 4.7 to about 7 inches) to accommodate different-sized feet, although spheres of greater or lesser diameters may be used.

As stated above, the second surface 14 of spherical base member 10 receives the plantar portion of a foot. To allow a single toe to be secured to the curved base member 10, as described below, two securing strips 16 and 18, such as Velcro loop material, are attached, for example by means of an adhesive, to surface 14. Between these securing strips 16 and 18 is an area which is left open which is adapted to receive the ball and toes of a foot. However, to enhance the functionality and effectiveness of the apparatus, curved base member 10 preferably further includes a trough 22 formed into or attached to the curved base member 10, and a ramp 20 formed into or attached to the surface 14 of the curved base member 10. Trough 22 preferably is a rectangular trough dug into the curved base member 10 having a width between about two and about four centimeters (about 0.8 inch and about 1.6 inches), a length between about four and about six centimeters (about 1.6 and about 2.4 inches), and a depth between one-half and one centimeter (about 0.2 and about 0.4 inch). The intersection of trough 22 with spherical base member 10 is designated as 23. A piece of securing material 26, such as Velcro loop material, is attached to the base of the trough 22 to aid in securing the foot to the curved base member 10, as described below. Trough 22 is used to accommodate a single toe or the ball of the foot of a user. The use of curved spherical base member 10 will be described in detail below.

The ramp 20 is preferably placed adjacent to and directly in front of and in line with trough 22, and is attached to the surface 14 of curved spherical base member 10 preferably by means of an adhesive. The intersection between the ramp 20 and the trough 22 is designated 25. Ramp 20 preferably has a width ranging from about two to about four centimeters (about 0.8 inch and about 1.6 inches), a length ranging from about four to about six centimeters (about 1.6 and about 2.4 inches), and an incline angle ranging from about fifteen to about twenty five degrees relative to a plane tangent to surface 14 at intersection 25. A piece of securing material 24, such as Velcro loop material, is attached to the incline face of the ramp 20 for aiding in securing a single toe to the curved spherical base member 10. As is detailed below, ramp 20 is used to support a toe when curved spherical base member 10 is used to impart dorsiflexion motion to the joint of the single secured toe.

Figure 2:
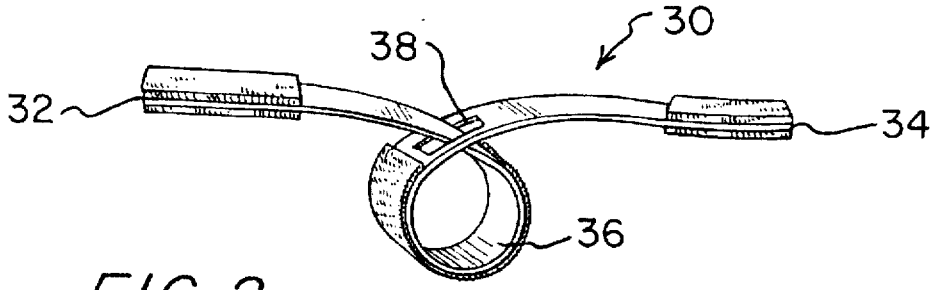
FIG. 2 is an enlarged perspective view of a loop strap used to secure a single toe to the spherical base member of FIGS. 1A and 1B.
Figure 3:
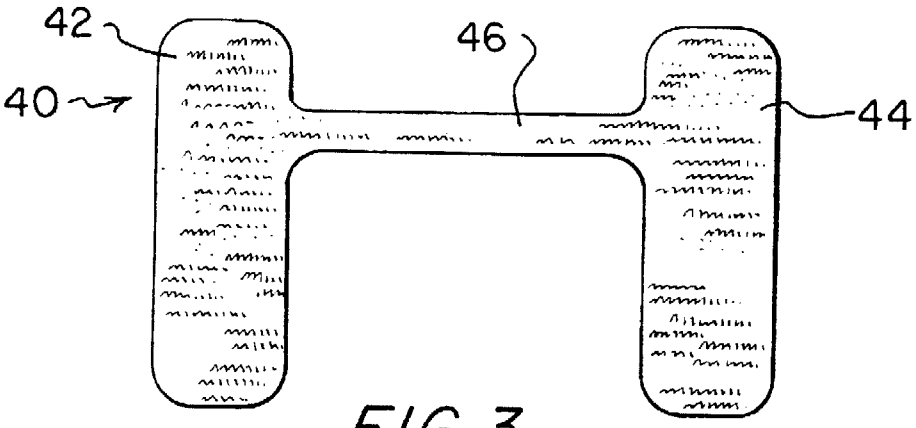
FIG. 3 is an enlarged bottom view of a butterfly strap used to further secure a single toe to the spherical base member of FIGS. 1A and 1B.

With reference to FIGS. 2 and 3, one form of single toe retainer of the present invention will now be described in detail. The retainer, as shown in FIG. 2, is a flexible strip of material formed into a loop strap 30. Loop strap 30 is comprised of a first end 32 and second end 34. A center loop 36 is formed by inserting end 32 through hole 38 in strap 30. To facilitate attachment to the securing strips 16 and 18 on the spherical base member 10, the ends 32 and 34 of strap 30 have attaching elements, such as Velcro hook material, adhered to both sides. Similarly, to aid in attaching loop 36 to Velcro securing material 26 in trough 22 or to Velcro securing material 24 on the ramp 20, the outer surface of loop strap 30 at loop 36 also preferably has Velcro hook material attached thereto. Strap 30 is preferably constructed of a strong, flexible, minimally stretchable material such as leather, nylon, Velcro cloth, or other similar materials.

As shown in a bottom view in FIG. 3, the retainer of the present invention preferably further includes a butterfly strap 40 having a first wide side portion 42, a narrow center portion 46, and a second wide side portion 44. Each of the side portions 42 and 44 is shown as having Velcro loop material attached thereto for facilitating their attachment to the securing strips 16 and 18 on the curved spherical base member 10. Like loop strap 30, butterfly strap 40 is preferably made of a strong, minimally stretchable material such as leather, nylon, Velcro cloth and the like.

Figure 4:
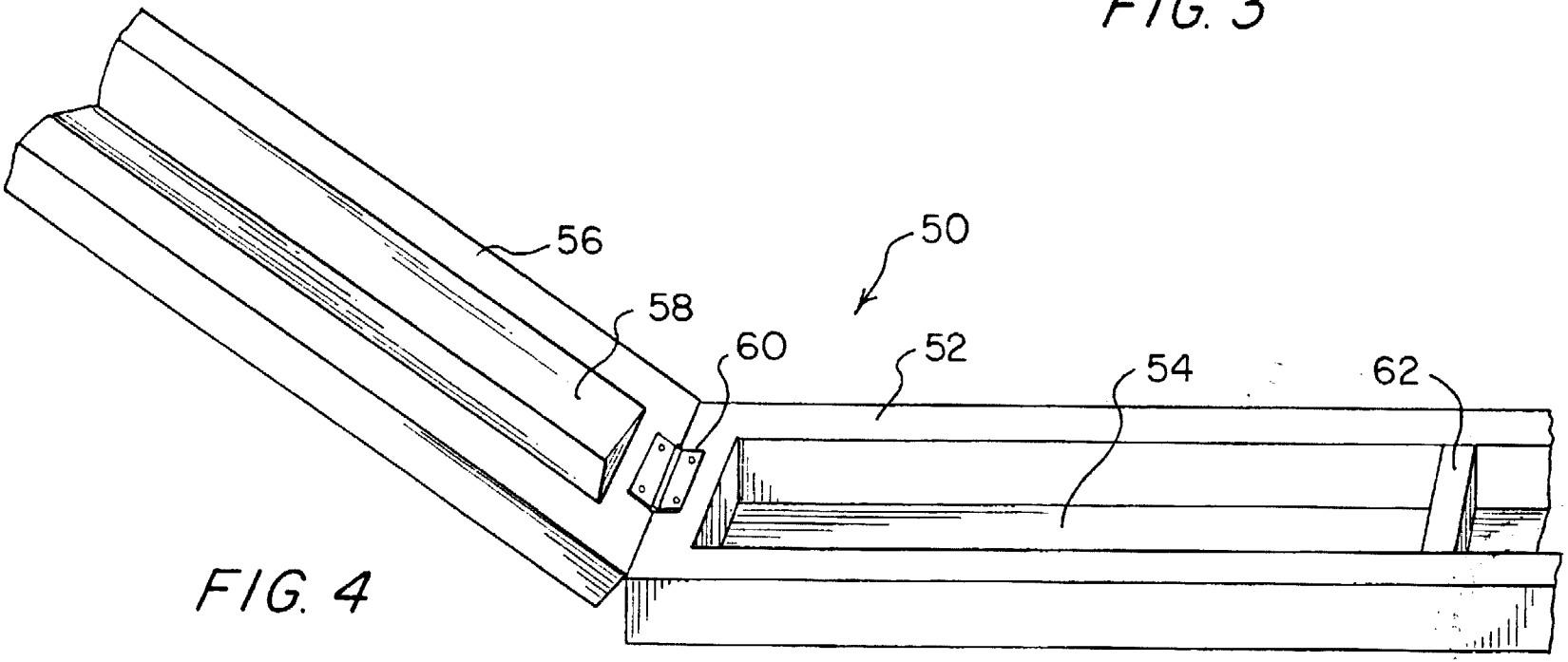
FIG. 4 is a perspective view of one form of tracking system for use with the spherical base member of FIGS. 1A and 1B.

A perspective view of the track system 50 which may be used with curved spherical base member 10 is provided in FIG. 4. Track system 50 preferably comprises a track 52 and a heel guide 56 attached to the track 52. The track 52 takes the form of an elongated piece of material defining a longitudinal cavity 54 formed therein. Track 52 may be constructed of a variety of rigid materials such as wood, plastic, metal, and the like. The purpose of track 52 and specifically of cavity 54 is to receive and guide the curved spherical base member 10 to assist the curved spherical base member 10 in rolling along a selected axis. To adequately serve this purpose, cavity 54 preferably has a width which is appropriate for stably supporting the curved spherical base member 10 as it rolls. The width of cavity 54 may vary depending upon the diameter and curvature of curved spherical base member 10. Track 52 may further include a removable insert 62 which may be secured snugly within cavity 54, and which may be placed anywhere along the length of the track 52. Insert 62 acts as a limit to prevent the curved spherical base member 10 from rolling beyond a certain point on the track, thereby limiting the arc of rotation of the curved spherical base member 10.

The heel guide 56 of track system 50 takes a form which is similar to that of track 52. Specifically, heel guide 56 comprises an elongated piece of rigid material defining a longitudinal V-shaped or U-shaped groove 58 formed therein for receiving and guiding the heel of a foot. Like track 52, heel guide 56 may be constructed of a variety of materials such as wood, plastic, metal, and the like. In the preferred embodiment, one end of heel guide 56 is pivotably attached to one end of track 52, for example by means of a hinge 60, while the other end of the heel guide 56 is left free to pivot. By moving the second end of heel guide 56, the angle between track 52 and heel guide 56 may be adjusted to form any desired angle. In the alternative, one end of heel guide 56 may be fixedly attached to or an integral part of (not shown) an end of track 52 to form a predetermined fixed angle with track 52.

Figure 5:
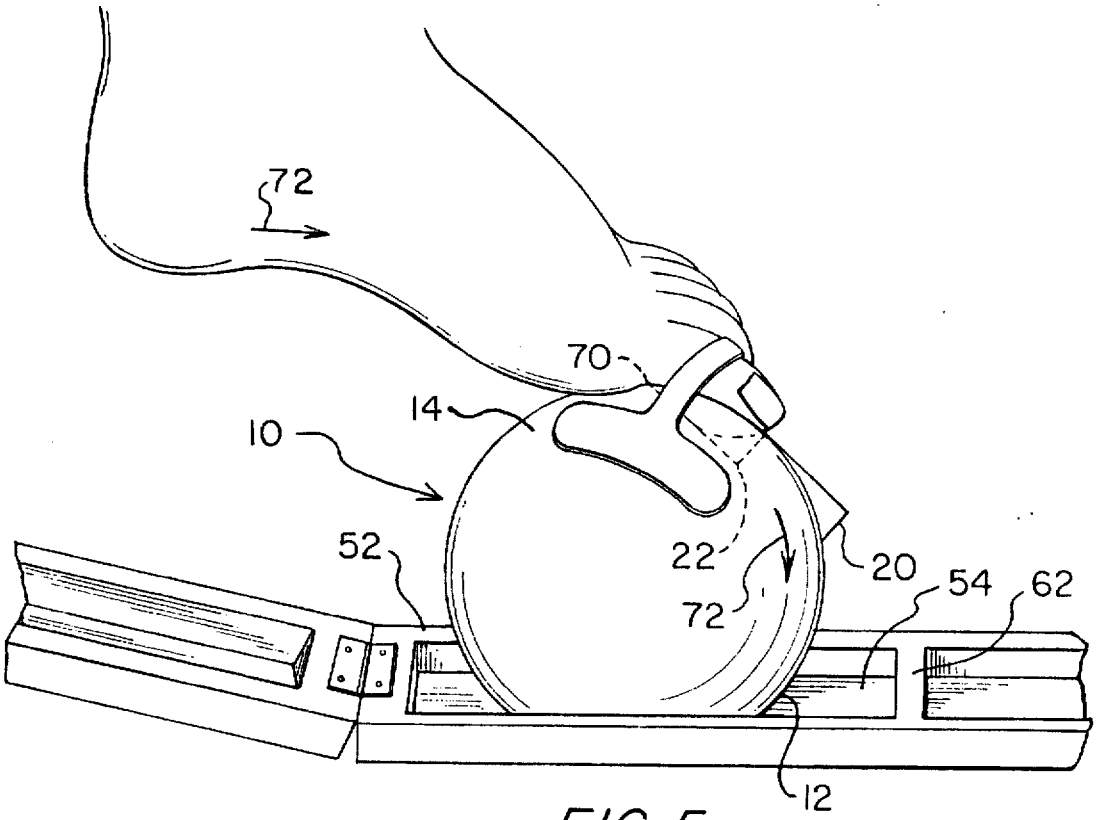
FIG. 5 is a side view of the apparatus of the present invention showing a foot having a single toe secured to the spherical base member of FIGS. 1A and 1B to illustrate the use of the apparatus in imparting plantarflexion motion to the MTP joint of a single toe.

The present invention may be used to impart both plantarflexion and dorsiflexion motion to the metatarsophalangeal (MTP) joint of one toe at a time. With reference to FIGS. 1–3 and FIG. 5, the use of the present invention to impart plantarflexion motion will now be described. The first step in using the apparatus of the present invention is to secure the single toe which is to be exercised to the curved spherical base member 10. For the sake of example, it will be assumed that the big toe 64 of the left foot 66 is the single toe that is to be exercised. It should be noted, however, that the present invention may be used to exercise any single toe on either foot. The single big toe 64 is shown secured to curved spherical base member 10 by first wrapping the center loop 36 of loop strap 30 around the proximal phalanx of the toe and then pulling on both ends 32 and 34 of the strap to tighten the loop 36 around toe 64. The loop 36 should fit as snugly as possible around the toe 64 without experiencing pain or compromising sensation or circulation to the toe. Thereafter, the single toe 64 is placed in the trough 22 and the ends 32 and 34 of the loop strap are placed in contact with the securing strips 16 and 18 on the curved spherical base member 10. The Velcro hook material on the exterior of the loop 36 attaches to the strip of Velcro loop material 26 in the trough 22, and the Velcro hook material on the ends 32 and 34 attach to the securing Velcro loop strips 16 and 18 on the curved spherical base member 10 to secure the single toe 64 to the curved spherical base member 10. As shown in FIG. 5, the metatarsophalangeal joint of the toe is preferably placed at the intersection 23 between the trough 22 and the round portion of surface 14 of curved spherical base member 10.

The toe 64 is further secured to the curved spherical base member 10 by using the butterfly strap 40. To do so, the first wide portion 42 of strap 40 is placed in contract with securing strip 18, the narrow portion 46 is placed over the big toe 64 and under the other toes, and the second wide portion 44 is placed beneath the foot and in contact with securing strip 16. The Velcro loop material on portions 42 and 44 attach to the securing on strips 16 and 18 to firmly hold the single toe 64 to the curved spherical base member 10.

With the single big toe 64 firmly secured to the curved spherical base member 10, the patient may begin exercising the toe. It should be noted here that the toe 64 may be effectively exercised using only curved spherical base member 10. The use of track system 50 is optional, and is not essential. However, track system 50 provides guidance which is helpful in controlling and directing the rolling motion of curved spherical base member 10. For this reason, track system 50 is preferably utilized when exercising a single toe. To use the curved spherical base member 10 in conjunction with track system 50, the curved surface 12 of curved spherical base member 10 is placed in cavity 54 of track 52 to allow the track 52 to guide the rolling of the curved spherical base member 10.

The apparatus of the present invention is preferably used from a sitting position. When the curved spherical base member 10 is initially placed in the track 52, the foot of the patient is preferably situated such that the foot 66 and single toe 64 are substantially horizontal, when in a resting position, and the heel of the foot is directly below the knee of the patient. To impart plantarflexion motion to the toe, the patient initiates a slow roll of the curved spherical base member 10 in the forward direction as indicated by arrow 72. As shown in FIG. 5, this forward rolling causes the toe to be pulled downward, thereby imparting plantarflexion motion to the MTP joint. The patient continues to roll the curved spherical base member 10 until the MTP joint is flexed to the proper degree, at which point the patient stops the rolling motion and holds the single toe 64 in the flexed position for a selected period of time.

At this point, the patient may position or reposition the insert 62 in cavity 54 of track 52 to put it at the point at which the curved spherical base member stopped rolling. This will ensure that the next time that the curved spherical base member 10 is rolled, it will stop rolling at the same point. After holding the single toe 64 in the flexed position for a brief period of time, the user then rolls the curved spherical base member 10 backward along the track 52 to return the toe to the initial resting position. Thereafter, the curved spherical base member 10 is again rolled forward to flex the MTP joint of single toe 64, and rolled backward to relax the joint. This rolling process is repeated until the MTP joint is adequately exercised. As already noted, this same procedure can be carded out without track 52, for example by rolling curved spherical base member 10 on the floor, or on any other appropriate firm surface.

Plantarflexion of the MTP joint of a single toe using this type of rolling motion is quite natural for the user, since, as the curved spherical base member 10 is rolled forward, the single toe 64 is pulled downward. This downward pull produces a gentle traction force on the MTP joint. Such a traction force is quite desirable because it stretches the soft tissue structures around the joint to loosen the joint and to increase blood circulation. CPM machines believed to be currently available are incapable of producing such a traction force.

Figure 6:
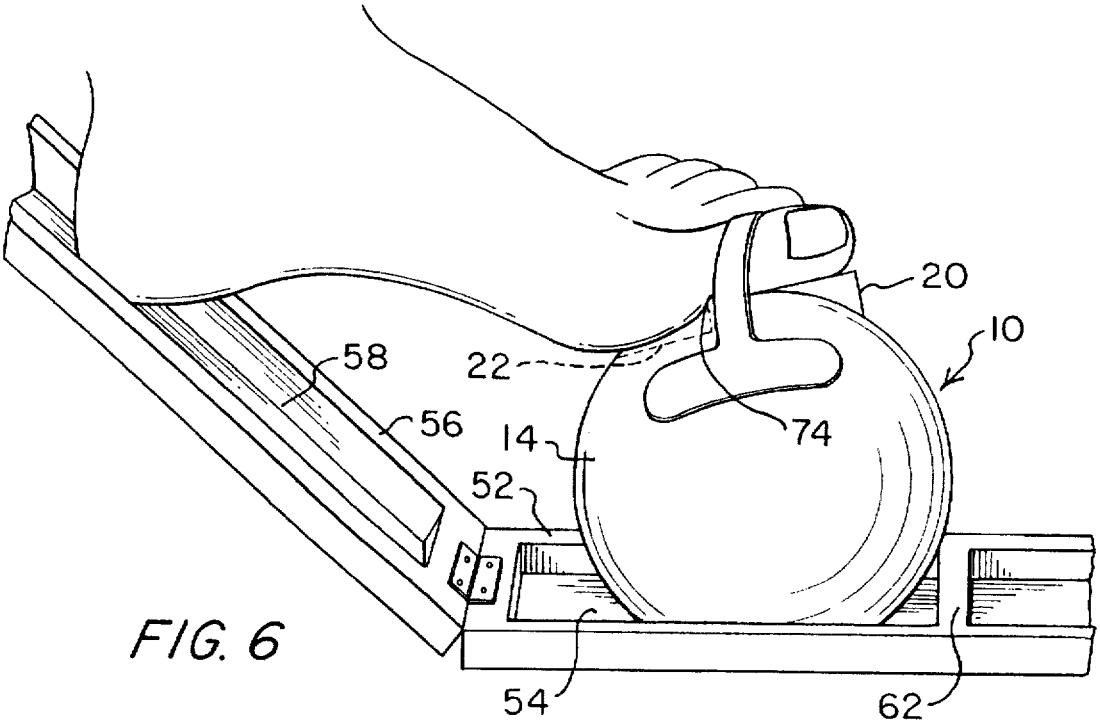
FIG. 6 is a side view of the apparatus of the present invention showing a foot having a single toe secured to the spherical base member of FIGS. 1A and 1B to illustrate the use of the apparatus in imparting dorsiflexion motion to the MTP joint of a single toe.

With reference to FIGS. 1–3 and FIG. 6, the use of the present invention to impart dorsiflexion motion to a single toe 64 will now be described. The first step in using the invention is to secure the toe 64 to be exercised to the curved spherical base member 10. As described above, this is accomplished by wrapping the center loop 36 of loop strap 30 around the proximal phalanx of the toe, pulling on the ends 32 and 34 of the strap 30 to tighten the loop 36 around the single toe 64, placing the toe 64 on the incline face of the ramp 20, and then placing the ends 32 and 34 of the strap 30 in contact with the securing strips 16 and 18 on the curved spherical base member 10. The Velcro hook material on the exterior of the loop 36 attaches to the Velcro loop material piece 24 on the ramp 20, and the Velcro hook material on the ends 32 and 34 of the strap 30 attach to the Velcro loop securing strips 16 and 18 to secure the toe 64 to the ramp 20 and to the curved spherical base member 10. As shown in FIG. 6, the toe 64 is preferably positioned such that the MTP joint is placed at the intersection 25 between the ramp 20 and the trough 22. Notice that in this configuration, it is the ball of the foot, not the toe 64, which sits within the trough 22.

The single toe 64 is further secured to the curved spherical base member 10 by using the butterfly strap 40. Specifically, portion 42 of the strap 40 is attached to securing strip 18, narrow portion 46 is placed over the big toe and under the other toes, and portion 44 is placed under the foot and attached to securing strip 16. The use of straps 30 and 40 serve to firmly secure the toe to the curved spherical base member 10.

After the single toe 64 is secured, the patient may begin exercising the toe. Again, the toe may be exercised using the curved spherical base member 10 alone, but for best results, track system 50 is preferably used in conjunction with curved spherical base member 10. To use the track system 50 in which the heel guide 56 is pivotable, the patient first adjusts the heel guide 56 to form the desired angle with track 52. Thereafter, the patient sits down and places the curved spherical base member 10 in a selected portion of the cavity 54 of track 52, such that the heel of the foot contacts the groove 58 in heel guide 56, and such that the foot is directly beneath the knee. Initially, the foot and to be exercised toe should be in a horizontal position. Once the foot is properly positioned, the insert 62 is preferably placed directly in front of curved spherical base member 10 to keep the curved spherical base member 10 from rolling forward. With the foot properly positioned, and the track system 50 properly set up, the single toe 64 may now be exercised.

Dorsiflexion is achieved by initiating a slow rolling motion in the backward direction. As the curved spherical base member 10 is rolled backward, as shown by arrow 74, the heel slides up the heel guide 56. At the same time, the rotation of the curved spherical base member 10 pushes the toe upward, thereby imparting dorsiflexion motion to the MTP joint of the single toe 64. The further the curved spherical base member 10 is rolled backward, the higher up the guide 56 the heel slides, and the higher the heel, the more the MTP joint is dorsiflexed. When the joint is flexed to a desired point, the patient stops the rolling motion and holds the curved spherical base member in position for a certain period of time. Thereafter, the patient rolls the curved spherical base member 10 forward to return the foot and single toe 64 to their resting position, and repeats the rolling process until the joint is adequately exercised. The amount that the joint of the single toe is flexed may be adjusted by varying the diameter of the curved spherical base member 10, the slope of the ramp 20, the relative angle of the heel guide 56, and the backward translation of the curved spherical base member 10.

Dorsiflexion of a joint using this type of rolling motion is advantageous because a "gliding" motion can be reproduced. Notice that as the curved spherical base member 10 is rolled backward, the toe is leveraged upward, thereby providing a dorsal glide to the proximal phalanx of the metatarsal. This gliding motion simulates the glide which is a common component of a regular walking motion. Hence, the apparatus of the present invention subjects the MTP joint to a more realistic type of motion than that provided by the CPM machines currently available. Again, this same procedure can be carried out with out track 52.

Figure 7:
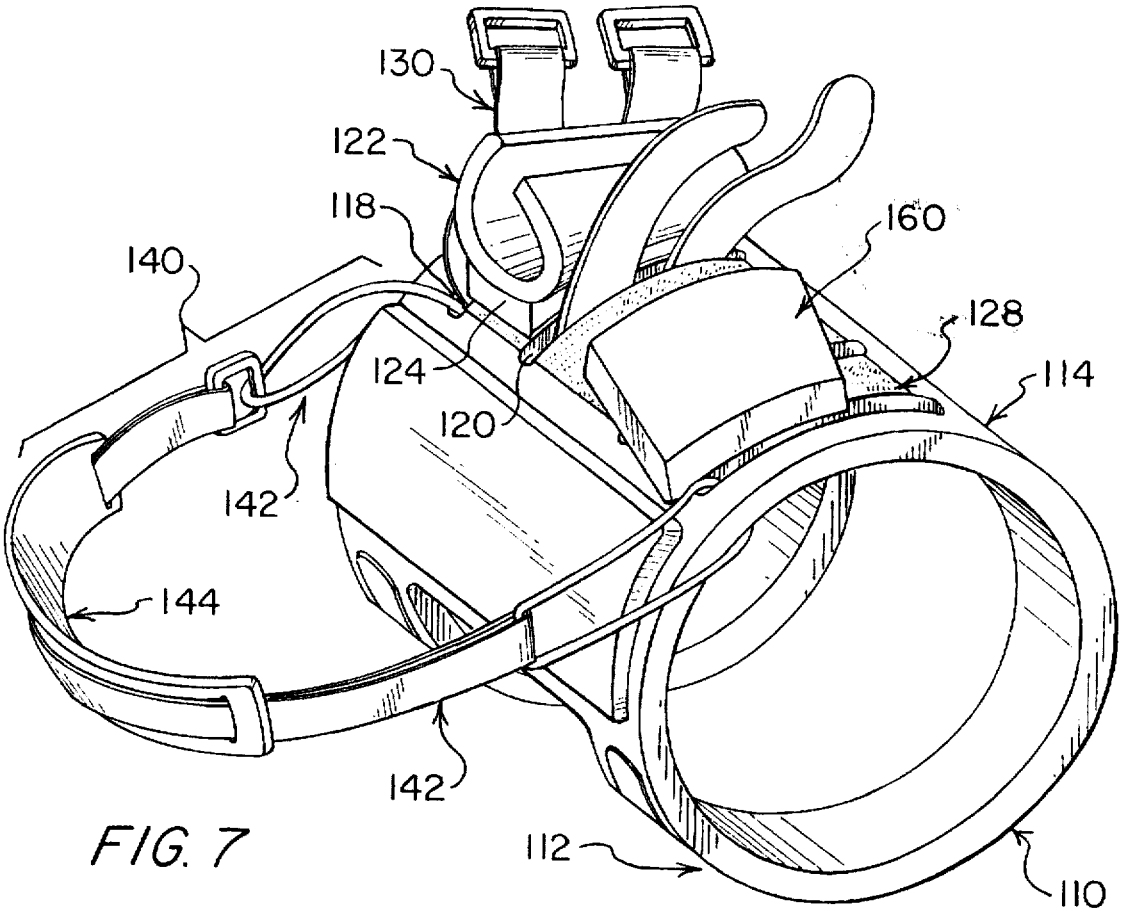
FIG. 7 is a perspective view of a second embodiment of the present invention in which the curved base member is in the form of a cylinder.

FIG. 7 is a perspective view of a second embodiment of the toe joint mobilization of the present invention in which the curved base member is in the form of a cylindrical roller 110. Roller 110, is constructed of substantially non-crushable, substantially non-deformable material such as rigid plastic, wood, metal, or rigid foam, or the like. The cylindrical roller 110 which is shown was constructed from a section of 4 inches (10 cm) diameter ABS pipe. The amount that the joint of the single toe is flexed may be adjusted by increasing or decreasing the diameter of the cylindrical roller 110.

The roller 110 has two significant curved surfaces. The first is a rolling surface 112, which is adapted to roll on the floor or on any other firm flat surface during use. The shape of rolling surface 112 is a curved section of a cylinder, in this case a section of the outside circumference of the ABS pipe from which roller 110 was constructed. The rolling surface 112 may be continuous, or, as shown, divided into two or more axially spaced partial rings by the removal of portions of the surface of the cylinder from which it is formed. By forming rolling surface 112 into two or more axially spaced partial rings, the points of contact between rolling surface 112 of roller 110 and the surface on which it is rolled are more precisely defined, thereby improving the directional stability of the device as it rolls, i.e. its ability to roll in a straight line. The exterior of rolling surface 112 may be textured to improve traction with the surface on which it is rolled, for example by removing material or by addition of textured material, such as non-skid tape.

The second surface 114 is a curved mounting surface for attaching a fixture 116 for retaining a to-be-treated single toe (not shown). Second surface 114 is also adapted to receive other components of the device which may interact with the toes which are not being treated, and the ball, arch, or heel of the foot (not shown). Where base member 110 is a cylinder, then second surface 114 is also an arc section of the outside circumference of the ABS cylinder, pipe from which it was constructed. In the preferred embodiment shown, second surface 114 has at least two pairs of through slots 118 and 120 located circumferentially, and spaced axially from one another at surface 114. The first pair of slots 118 is located closely adjacent one end of cylinder 110, the second pair of slots 120 being located axially inboard therefrom. Each pair of slots are about 2.5 inches by about 0.25 inch (6.3–0.6 cm) wide, spaced circumferentially about 1 inch (2.5 cm) apart, with about a 1.5 inches (3.75 cm) axial spacing between pairs 118 and 120. The pairs of through slots 118 and 120 bracket single toe retainer fixture 122 which is used to secure and position a single toe to the cylindrical base member 110 of FIG. 7. While not shown, other recesses, slots, protrusions and the like may be provided to facilitate attaching other elements to the second surface 114 of roller 110.

Figure 8:
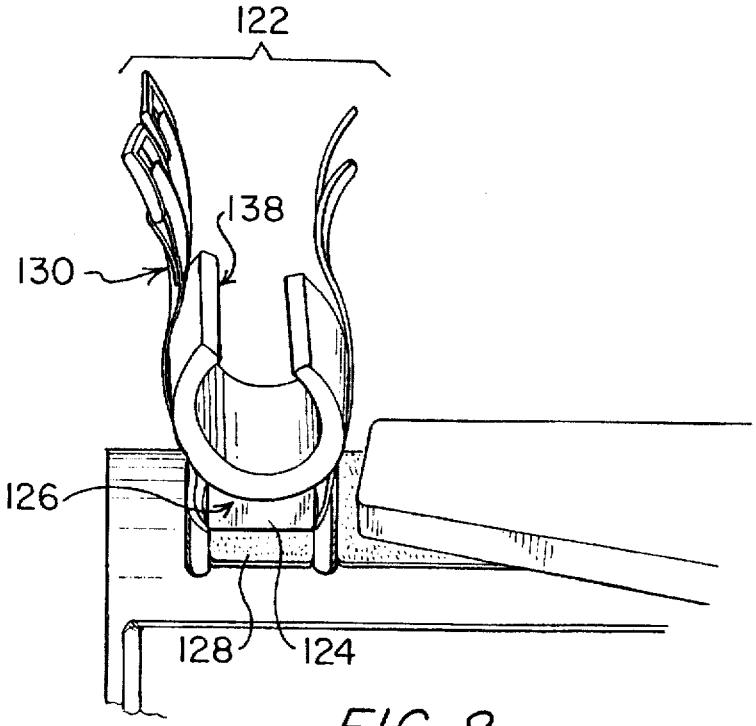
FIG. 8 is an enlarged perspective view of a single toe retainer fixture used to secure a single toe to the cylindrical base member of FIG. 7.

Now referring to FIG. 8, an enlarged perspective view of single toe retainer fixture 122 is provided. Single toe retainer fixture 122 includes a toe base block 124 which is shaped to receive and grasp the to-be-treated single toe, not shown. This is accomplished in this embodiment by providing a concave upper surface 126 which positions the MTP joint of the single to-be-treated toe in a position which allows maximum glide of the joint, and by positioning the toe approximately 0.5 inch (1.3 cm) above the mounting surface 114 of the roller 110, thereby allowing the metatarsal head of the to-be-treated single toe to drop towards the roller 110 during plantarflexion. Toe base block 124 receives the plantar surface of the to-be-treated single toe, and is contoured on its lower surface to fit the curve of mounting surface 114 of the roller 110. In this case, the toe base is about 2 inches (5.1 cm) long, about 0.5 inch (1.3 cm) high, and about 0.5 inch (1.3 cm) wide, and is composed of close-celled foam. Toe base block 124 may also be constructed plastic, wood, or metal.

In this preferred embodiment the toe base block 124 attaches to the mounting surface of the roller 110 using Velcro hook material, not shown, which adheres to Velcro loop material pad 128 which is adhered to mounting surface 114. While the toe base block 124 is shown as being a rectilinear block, it may function effectively in other shapes, for example in the shape of a ramp. Velcro loop material pad 128 on surface 114 is larger than that on the toe base block 124 to facilitate placement of pad 128 for selective treatment of any single toe of either the left or the right foot. However, other mechanical fasteners for connecting toe base block 124 to roller 110 may be used, or toe base block 124 may be molded or formed as a portion of the roller 110 itself.

The second element of the toe fixture 122 is the toe strap system which includes at least one toe strap 130. In the preferred embodiment shown, a pair of toe straps 130 serve to secure the to-be-treated single toe to the toe base block 124, which is secured to the roller 110. Toe straps 130 are preferably constructed of flexible, elastic material, and are capable of being secured together by Velcro hook and loop material 132, although, buckles, or snaps, or other art known closure systems may be used with straps 130 for this purpose. In the embodiment shown the toe strap system consists of two Velcro "buckle" straps 130, each about 8 inches long and about 1 inch (2.5 cm) wide, with a D-ring 136 secured to one end to secure the straps 130. A U-shaped toe pad 138 made of soft flexible material is positioned between the straps and the to-be-treated single toe. In the embodiment shown, U-shaped toe pad 138 consists of an about 4 inches (10.2 cm) long by about 2 inches (5.1 cm) wide by about 0.125 inch (0.3 cm) thick Neoprene rubber pad which is glued to the top of the base block 124.

In use, U-shaped toe pad 138 is wrapped around the to-be-treated single toe. Each toe strap 130 passes through two of the through slots 118 and 120 in the mounting surface 114 of the roller 110, around the toe base block 124 and the toe pad 138 and over the top of the to-be-treated single toe, thereby securing the toe to the toe base block 124, and thence to roller 110.

The third component of the system is heel retainer 140. Heel retainer 140 consists of a heel strap 142 of flexible material. The heel strap 142 material may be constructed of either elastic or inelastic material, may be adjustable in length and preferably includes a heel pad 144 composed of soft material. The heel strap 142 is attached to one end of the mounting surface 114 of the roller 110 near the location of the MTP joint of the to-be-treated single toe, and is adapted to then pass around the back of the heel of the user (not shown), and terminates on the other end of the mounting surface 114 in a circumferential location on the roller 110 similar to, but opposed to its origin. The heel strap 142 serves to prevent sliding motion between a user's to-be-treated single toe and the roller 110. By preventing sliding motion heel strap 142 significantly reduces the strapping force which is required to be applied by the toe straps 130 to hold the to-be-treated single toe in position. In this case, the heel retainer 140 consists of two 3 inches loops of 0.125 inch (0.3 cm) elastic cord 146, one loop being attached on each opposed end of the mounting surface 114 of the roller 110, and connected by a Velcro "buckle" strap 148, in a manner similar to the toe straps 130 which are adapted to pass around the heel of a user. The Velcro "buckle" strap 148 carries a padded 6 inches (15.2 cm) by 2 inches (5.1 cm) by 0.125 inch (0.3 cm) thick Neoprene rubber heel pad 150. Heel pad 150 carries slots 152 near each end to allow it to slide over the closed Velcro strap 148.

A foot pad 160 is comprised of one or more pieces of foam, plastic, wood, or metal which are attached to the mounting surface 114. Foot pad 160 may be attached to the mounting surface 114 using glue, Velcro hook and loop material, or other mechanical fastening devices, or it may be formed as an integral part of the roller 110. The foot pad 160 is shaped to receive the toes not being treated, as well as the ball and arch of the foot of the patient. In this case the foot pad 160 is composed of two elements. The first element, the toe rest 162 is preferably a close-celled foam pad about 2 inches (5.1 cm) by about 2 inches (5.1 cm) by about 0.5 inch (1.27 cm) thick. In the preferred embodiment shown in FIGS. 7 and 8, toe rest 162 is attached to the roller 110 with Velcro hook and loop material. The toe rest 162 is adjustable in position in a similar manner to the toe base block 124. The second element, is an arch pad 164 which, in preferred embodiments is a Neoprene rubber pad about 5 inches (12.7 cm) by about 3 inches (7.6 cm) by about 0.125 inch (0.3 cm) thick, and is preferably glued to the mounting surface 114 of the roller 110. The arch pad 164 serves to contact and support the plantar surface of the ball and arch of the foot of the person using the device.

To use the device, a to-be-treated single toe is placed on the toe base block 124, with the other toes and the ball of the foot resting on the foot pad 160. The to-be-treated single toe is secured to the device by fastening the toe fixture system 122 using toe straps 130. In this case, the toe pad 138 is wrapped around the to-be-treated single toe, then the pair of toe straps 130 are positioned over the top of the toe and secured. The heel retainer 140 is then positioned around the back of the heel of the user, and its length is adjusted provide adequate retention of the to-be-treated single toe. The device is then placed on the floor directly below the knee. To operate the device, the user moves the foot forward, which due to the curvature of the rolling surface 112 of the device, imparts a downward rotation of the first phalanx of the to-be-treated single toe about the MTP joint, producing plantarflexion of the MTP joint. The user then moves the foot backward to similarly impart an upward rotation of the first phalanx of the to-be-treated single toe about the MTP joint, which produces dorsiflexion of the MTP joint.

The present invention has thus far been described as using Velcro for attaching the retaining straps to the member. While this is the preferred embodiment, it should be noted that other methods and means for attachment may be used instead. For example, the retaining straps may be attached to the member using snaps, buttons, clips, and other similar means. These and other similar alternatives are within the contemplation of the present invention.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention. It should be further understood and that the scope of the present invention is to be limited only to the claims except as precluded by the prior art. Moreover, the invention as disclosed herein, may be suitably practiced in the absence of the specific elements or steps which are disclosed herein.

What is claimed is:

1. An apparatus for passively mobilizing and imparting plantarflexion and dorsiflexion motion to a metatarsophalangeal (MTP) joint of a to-be-treated single toe of a human foot, comprising:

a substantially non-deformable, member having a first curved bottom surface for facilitating the rolling of said member on a firm surface, and a second substantially opposed curved upper surface adapted to receive at least a portion of the plantar portion of a human foot including at least a portion of the ball of the foot and at least one to-be-treated toe; and receiving and retaining means for securing a single to-be-treated toe to said second curved upper surface, said single to-be-treated toe receiving and retaining means attached to said second curved upper surface of said member; whereby, as said member is rolled in a forward direction on its said first curved surface a single to-be-treated toe which is secured to said receiving and retaining means is pulled downward due to the curvature of said first current bottom surface of said member to thereby impart plantarflexion motion to the MTP joint of a secured single to-be-treated toe, and as said member is rolled in a backward direction, a secured single to-be-treated toe is pushed upward due to the curvature of said first and second surfaces of said member to impart dorsiflexion motion to the MTP joint of the secured single to-be-treated toe.

2. The apparatus of claim 1, wherein said member is in the shape of a substantially spherical ball.

3. The apparatus of claim 1, wherein said single to-be-treated toe receiving and retaining means is attachable to and detachable from said second curved surface of said member.

4. The apparatus of claim 3, wherein said second curved surface of said member includes first and second means for receiving said single to-be-treated toe receiving and retaining means, and wherein said single to-be-treated toe receiving and retaining means includes a flexible loop strap having a first end attachable to said first receiving means and a second end attachable to said second receiving means of said member, and a middle section including means for wrapping snugly around a single to-be-treated toe to secure such a toe to said member when said first and second ends are attached to said first and second receiving means.

5. The apparatus of claim 1, further including a track adapted to receive said first curved surface of said member for guiding said member to ensure that said member moves along a selected axis, said track having a first end and a second end.

6. The apparatus of claim 5, further including an elongated heel guide having a first end and a second end, said second end of said elongated heel guide attached to said first end of said track at an angle, said heel guide having a longitudinal groove formed therein for receiving and guiding the heel of the foot of a user as said member is rolled in a backward direction.

7. The apparatus of claim 5, further including an elongated heel guide having a first end and a second end, said second end of said elongated heel guide being pivotally attached to said first end of said track at an angle, said heel guide having a longitudinal groove formed therein for receiving and guiding the heel of the foot of a user as said member is rolled in a backward direction.

8. The apparatus of claim 1, wherein said member includes a trough formed in said second curved surface for receiving a single to-be-treated toe as said member is rolled in a forward direction to impart plantarflexion motion to the MTP joint of a secured single to-be-treated toe received in said trough.

9. The apparatus of claim 1, wherein said member includes a trough formed in said second curved surface, and wherein said second curved surface further includes a ramp for accommodating a single to-be-treated toe, said ramp raising a single to-be-treated toe to a selected angle relative to said second curved surface to impart dorsiflexion motion to the MTP joint of a secured single to-be-treated toe as said member is rolled in a backward direction.

10. The apparatus of claim 9, wherein said ramp is placed adjacent to and directly in front of and in line with said trough.

11. The apparatus of claim 10, wherein said member is a substantially spherical ball.

12. The apparatus of claim 1, wherein said member is in the shape of a substantially cylindrical roller.

13. The apparatus of claim 12, wherein said first curved surface is a portion of a surface of a cylinder.

14. The apparatus of claim 13, wherein said first curved surface includes two or more axially spaced partial rings.

15. The apparatus of claim 12, wherein said first curved surface is textured to improve traction with the surface on which it is rolled.

16. The apparatus of claim 12, wherein said means for receiving and retaining a to-be-treated single toe includes at least one flexible toe strap to secure a to-be-treated single toe within said means for receiving and retaining a to-be-treated single toe.

17. The apparatus of claim 12, wherein said means for receiving and retaining a to-be-treated single toe includes two flexible toe straps to secure a to-be-treated single toe within said means for receiving and retaining a to-be-treated single toe.

18. The apparatus of claim 12, wherein said means for receiving and retaining a to-be-treated single toe includes a toe base block which is shaped and adapted to receive and grasp a to-be-treated single toe.

19. The apparatus of claim 12, wherein said cylindrical member includes means for retaining the heel of the user to prevent sliding motion between a user's to-be-treated single toe and said cylindrical roller.

20. An apparatus for passively mobilizing and imparting plantarflexion and dorsiflexion motion to a metatarsophalangeal (MTP) joint of a single toe of a human foot, comprising:

a substantially non-deformable cylindrical roller member having a first curved surface for facilitating the rolling of said member on a firm surface, and a second curved surface adapted to receive at least a portion of the plantar portion of a human foot including at least a portion of the ball of the foot and at least one to-be-treated toe;

means for receiving and retaining a to-be-treated single toe attached to said second curved surface, said receiving and retaining means including a toe base block which is shaped and adapted to receive and grasp a to-be-treated single toe;

at least one flexible toe strap positioned adjacent said receiving and retaining means to secure a to-be-treated single toe within said receiving and retaining means; and means for retaining the heel of the user to prevent sliding motion between a user's to-be-treated single toe and said cylindrical roller, said means for retaining the heel of the user being attached to said cylindrical roller; whereby, as said cylindrical roller member is rolled in a forward direction on its said first curved surface a single to-be-treated toe secured within said means for receiving and retaining a to-be-treated single toe is pulled downward due to the curvature of said first surface of said member to thereby impart plantarflexion motion to the MTP joint of a secured single to-be-treated toe, and as said member is rolled in a backward direction, a secured single to-be-treated toe secured to said means for receiving and retaining a to-be-treated single toe is pushed upward due to the curvature of said first surface of said member to impart dorsiflexion motion to the MTP joint of the secured single to-be-treated toe.

21. An apparatus for mobilizing and imparting plantarflexion and dorsiflexion motion to a metatarsophalangeal (MTP) joint of a single toe of a human foot, comprising:

a substantially non-deformable spherical member having a first curved surface for facilitating the rolling of said member on a firm surface, and a second curved surface adapted to receive at least a portion of the plantar portion of a human foot including at least a portion of the ball of the foot and at least one to-be-treated toe, wherein said second curved surface includes a trough formed in said second surface adapted to receive a single to-be-treated toe, and wherein said second curved surface further includes a ramp, said ramp being adapted to raise a single to-be-treated toe to a selected angle relative to said second surface; and a retainer adapted to secure a single to-be-treated toe to said second surface, said retainer attached to said second surface of said member, wherein said second surface of said member includes first and second means for receiving said retainer, and wherein said retainer includes a flexible loop strap having a first end attachable to said first receiving means and a second end attachable to said second receiving means of said member, and a middle section adapted to be wrapped snugly around a single to-be-treated toe to secure such a toe to said member when said first and second ends are attached to said first and second receiving means; whereby, as said spherical member is rolled in a forward direction on its said first curved surface a single to-be-treated toe secured within said trough is pulled downward due to the curvature of said first surface of said member to thereby impart plantarflexion motion to the MTP joint of a secured single to-be-treated toe, and as said member is rolled in a backward direction, a secured single to-be-treated toe secured to said ramp is pushed upward due to the curvature of said first surface of said member to impart dorsiflexion motion to the MTP joint of the secured single to-be-treated toe.

22. An apparatus for mobilizing a metatarsophalangeal (MTP) joint of a human foot, comprising:

a member having a first curved surface for facilitating the rolling of said member along a selected axis, and a second surface adapted to receive the plantar portion of a human foot including at least a portion of the ball of the foot and at least one toe;

a retainer attachable to said member for securing a single to-be-treated toe to said second surface;

a track adapted to receive said curved surface of said member for guiding said member to ensure that said member moves along said axis, said track having a first end and a second end; and an elongated heel guide having a first end and a second end, said second end of said elongated heel guide attached at an angle to said first end of said track said heel guide having a longitudinal groove formed therein for receiving and guiding the heel of the foot of a user as said member is rolled in a backward direction; whereby, as said member is rolled in a forward direction along said selected axis, the secured to-be-treated single toe is pulled downward due to the curvature of said first and second surfaces of said member to thereby impart plantarflexion motion to the MTP joint of the secured to-be-treated single toe, and as said member is rolled in a backward direction the secured to-be-treated single toe is pushed upward due to the curvature of said first and second surfaces of said member to impart dorsiflexion motion to the MTP joint of the secured single toe.

23. A method for passively exercising a metatarsophalangeal (MTP) joint of a human foot, comprising the steps of:

providing a member having a first curved surface and a second curved surface;

placing the forward portion of the foot including at least a portion of the ball of the foot and at least one to-be-treated toe onto said second surface;

securing a single to-be-treated toe to said second surface using a retainer; and then selectively rolling said member in a forward direction relative to the foot to cause the secured single toe to be pulled downward due to the curvature of said first and second surfaces, thereby passively imparting plantarflexion motion to the MTP joint of the secured single toe, or selectively rolling said member in a backward direction relative to the foot to cause the secured single me to be pushed upward due to the curvature of said first and second surfaces, thereby passively imparting dorsiflexion motion to the MTP joint of the secured single toe.

24. An apparatus for passively mobilizing and imparting plantarflexion and dorsiflexion motion to a metatarsophalangeal (MTP) joint of a single toe of a human foot, comprising:

a substantially non-deformable, member in the shape of a substantially cylindrical roller having a first curved surface for facilitating the rolling of said member on a firm surface, and a second substantially opposed curved surface adapted to receive at least a portion of the plantar portion of a human foot including at least a portion of the ball of the foot and at least one to-be-treated toe; and receiving and retaining means for securing a single to-be-treated toe to said second curved surface, said single to-be-treated toe receiving and retaining means attached to said second surface of said member, said means for receiving and retaining a to-be-treated single toe including a toe base block which is shaped and adapted to receive and grasp a to-be-treated single toe; whereby, as said member is rolled in a forward direction on its said first curved surface a secured single to-be-treated toe is pulled downward due to the curvature of said first curved surface of said member to thereby impart plantarflexion motion to the MTP joint of that secured single to-be-treated toe, and as said member is rolled in a backward direction, a secured single to-be-treated toe is pushed upward due to the curvature of said first surface of said member to impart dorsiflexion motion to the MTP joint of the secured single to-be-treated toe.

* * * * *